US006138467A

United States Patent [19]

Lifson et al.

[11] Patent Number: 6,138,467

[45] Date of Patent: Oct. 31, 2000

[54] STEADY STATE OPERATION OF A REFRIGERATION SYSTEM TO ACHIEVE OPTIMUM CAPACITY

[75] Inventors: Alexander Lifson, Manlius, N.Y.; Boris Karpman, Marlborough, Conn.

[73] Assignee: Carrier Corporation, Farmington, Conn.

[21] Appl. No.: 09/212,752

[22] Filed: Dec. 16, 1998

Related U.S. Application Data

[60] Provisional application No. 60/097,252, Aug. 20, 1998.

[51] Int. Cl.[7] ..... F25B 41/04

[52] U.S. Cl. ..... 62/217; 62/196.3; 62/200; 62/228.3; 62/228.5; 62/513; 236/1 E

[58] Field of Search ..... 62/217, 228.1, 62/228.3, 228.5, 199, 200, 196.3, 513; 236/1 E

[56] References Cited

U.S. PATENT DOCUMENTS

| | | | |
|---|---|---|---|
| 3,899,897 | 8/1975 | Boerger et al. | 62/196 |
| 4,789,025 | 12/1988 | Brandemuehl et al. | 165/30 |
| 4,798,057 | 1/1989 | Okamoto et al. | 62/228.3 |
| 4,819,441 | 4/1989 | Hanson | 62/160 |
| 4,875,341 | 10/1989 | Brandemuehl et al. | 62/115 |
| 4,899,549 | 2/1990 | Berge et al. | 62/160 |
| 4,903,502 | 2/1990 | Hanson et al. | 62/228.5 |
| 4,977,751 | 12/1990 | Hanson | 62/81 |
| 5,022,234 | 6/1991 | Goubeaux et al. | 62/228.5 |
| 5,582,022 | 12/1996 | Heinrichs et al. | 62/175 |
| 5,761,918 | 6/1998 | Jackson et al. | 62/181 |
| 5,907,957 | 6/1999 | Lee et al. | 62/217 |

*Primary Examiner*—William Doerrler
*Assistant Examiner*—Marc Norman
*Attorney, Agent, or Firm*—Carlson, Gaskey & Olds

[57] ABSTRACT

A method of operating a refrigeration system in steady state operation drives the refrigerant system to the lowest capacity state which is still able to maintain operation within acceptable pressure and temperature limits. Generally, the system seeks to minimize the on and off compressor cycling. The lowest capacity state is achieved by throttling the compressor suction and by staging down the compressor operation from economized to normal and to unloaded mode while assuring that desired box temperature is maintained. Safety methods are incorporated into the system to ensure that the operation does not violate limits on suction pressure, discharge pressure, and compressor discharge temperature.

9 Claims, 2 Drawing Sheets

START
PULLDOWN
PULLDOWN COMPLETE ?
NO
YES
100
5MV MODULATION FROM ERROR DEFINED AS (T-BOX - T-BOX SET)
102
104
% 5 MV< MIN TIMER
NO
% 5MV>MAX TIMER
NO
YES
108
106
YES
MOVE TO LOWER CAPACITY MODE
MOVE TO HIGHER CAPACITY MODE
110
NO
P_SUC< MIN
YES
112
5 MV MODULATION FROM ERROR DEFINED AS ( P_SUC SET - P_SUC)
114
116
NO
YES
T_BOX>T_BOX SET + DELTA
NO
T_BOX<T_BOX SET - DELTA
120
118
YES
YES
T_BOX >T BOX SET + DELTA
CYCLE OFF COMPRESSOR
NO

STEADY STATE OPERATION OF A REFRIGERATION SYSTEM TO ACHIEVE OPTIMUM CAPACITY

This appln claims the benefit of U.S. Provisional No. 60/097,252 filed Aug. 20, 1998.

BACKGROUND OF THE INVENTION

This invention relates to a method of optimizing a control scheme of a refrigeration system during steady state operation. In particular, the method is directed to a container refrigeration system.

A refrigeration system attached to the container cools the goods within the container to a target temperature. In the steady state regime system cooling capacity must be matched to the required refrigeration load in order to maintain tight temperature control. At any given point in time, the refrigeration system cooling capacity is determined by the system operating conditions, which in turn depend on the ambient temperature, the temperature inside the refrigerated container and the characteristics, and mode of operation, of the compressor and other refrigeration system components, such as suction modulation valve, heat exchangers, etc. On the other hand, the required refrigeration load is mostly a function of ambient temperature, temperature in refrigerated space, product respiration load and container size and insulation characteristics.

Once the system has reached, or at least approached, the target temperature, it is necessary to continuously adjust the capacity of the refrigeration system, while maintaining operation within a predetermined range of the target temperature. In the past, the controls associated with the refrigeration systems have not been sophisticated enough to achieve the reduced capacity while maintaining reliable and energy efficient system operation with accurate temperature control. Instead, generally, the refrigeration systems have simply on/off-cycled the compressor. Despite the simplicity and ease of on and off control, many refrigeration systems cannot effectively use this method due to the inability to maintain a tight temperature control in the refrigerated space. Further, this method has sometimes had reliability problems with electric motors and compressors caused by mechanical and/or electrical overloading due to the on/off cycling. Finally, in applications wherein there are widely varying load conditions, this method results in poor energy efficiency.

The prior art tried to achieve tight temperature control using throttle valves in the suction lines, and additional components such as compressor unloaders, bypass schemes, split coils, variable speed drives, multiple compressors, and various operations of the several systems to achieve the reduced capacity. However, these techniques often proved to be costly or unreliable thus there has still been a desire to achieve a more sophisticated method of controlling the capacity to optimize steady state control with respect to temperature control accuracy, energy efficiency and reliability.

SUMMARY OF THE INVENTION

In a disclosed embodiment of this invention, a microprocessor-based control algorithm attempts to tailor refrigeration cycle configuration in a way that results in the best match between required cooling load and available system capacity. The system available capacity is adjusted through several steps of capacity control and fine-tuned via continuous modulation of suction throttling valve. High temperature, low suction pressure, and high discharge pressure limits are monitored to ensure reliable operation. Control logic is altered in order to maintain the limits in a way that establishes desired tradeoff between energy efficiency, reliability and control accuracy across operating envelope.

The present invention will be explained in some detail below, however, it should be understood that many modifications of the detailed method to be described would come within the scope of this invention.

DETAILED DESCRIPTION OF A PREFERRED EMBODIMENT

Figure 1:
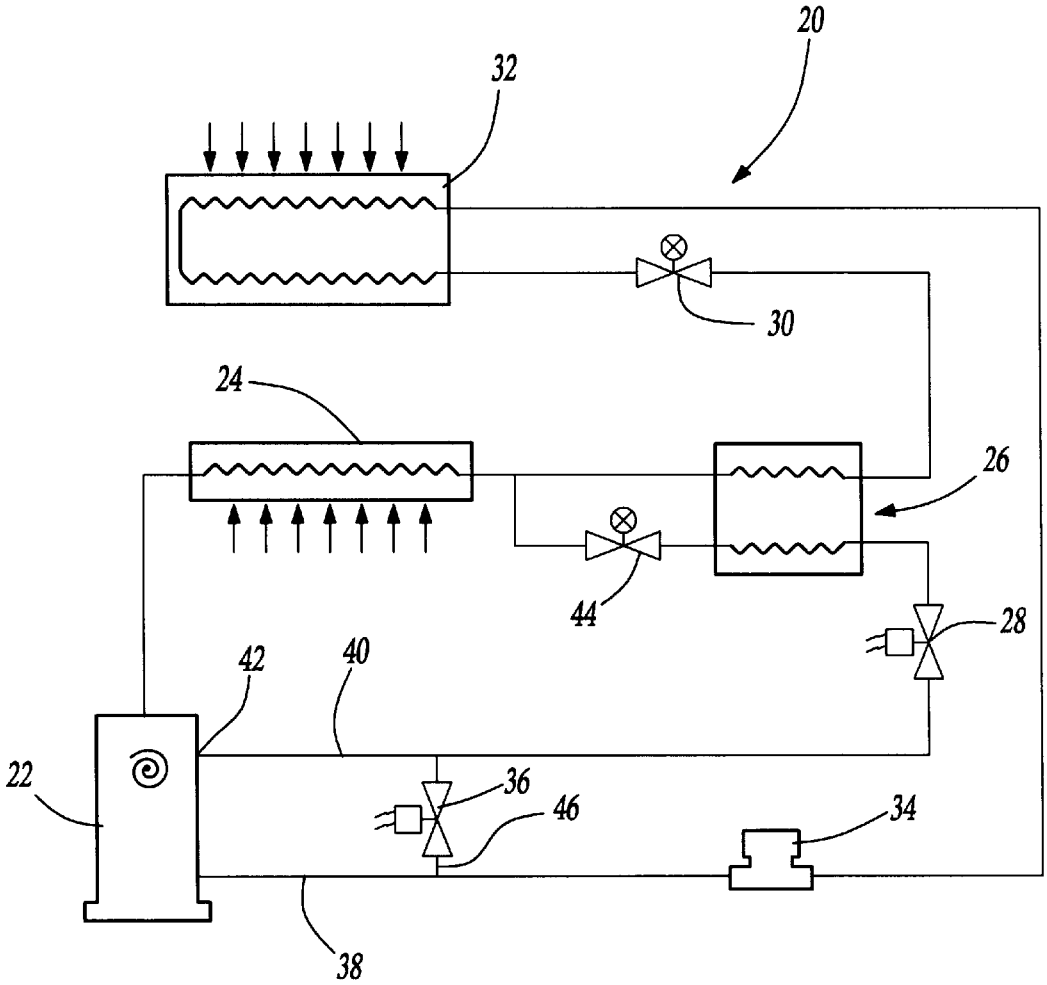
FIG. 1 schematically shows a refrigeration system.

A refrigeration system 20 is illustrated in FIG. 1 having a compressor 22 delivering a refrigerant to a condenser 24. The condenser 24 delivers refrigerant to an economizer heat exchanger 26. From the economizer heat exchanger, a portion of the refrigerant passes into an evaporator expansion device 30, and then to the evaporator itself 32. From evaporator 32, the refrigerant passes to a suction throttling device 34, and then back to compressor 22. This is a basic refrigeration system, as is known.

As known, a portion of the fluid from condenser 24 expands through economizer expansion device 44 and passes through the economizer heat exchanger and is returned to the compressor via economizer shutoff valve 28, into an economizer port 42, if the economizer shutoff valve 28 is open. An unloader valve 36, positioned in by-pass line 46, communicates the economizer line 40 to the suction line 38, and is selectively opened to reduce the capacity in an unloaded state of operation. This economizer and unloader valve positioning is disclosed in co-pending U.S. patent application Ser. No. 09/114,395, entitled "Scroll Compressor with Unloader Valve Between Economizer and Suction" and filed on Jul. 13, 1998.

Preferably, the refrigeration system 20 is used for cooling a container box for holding a cargo. That is, the box air, such as shown, is being delivered against the evaporator 32.

Figure 2:
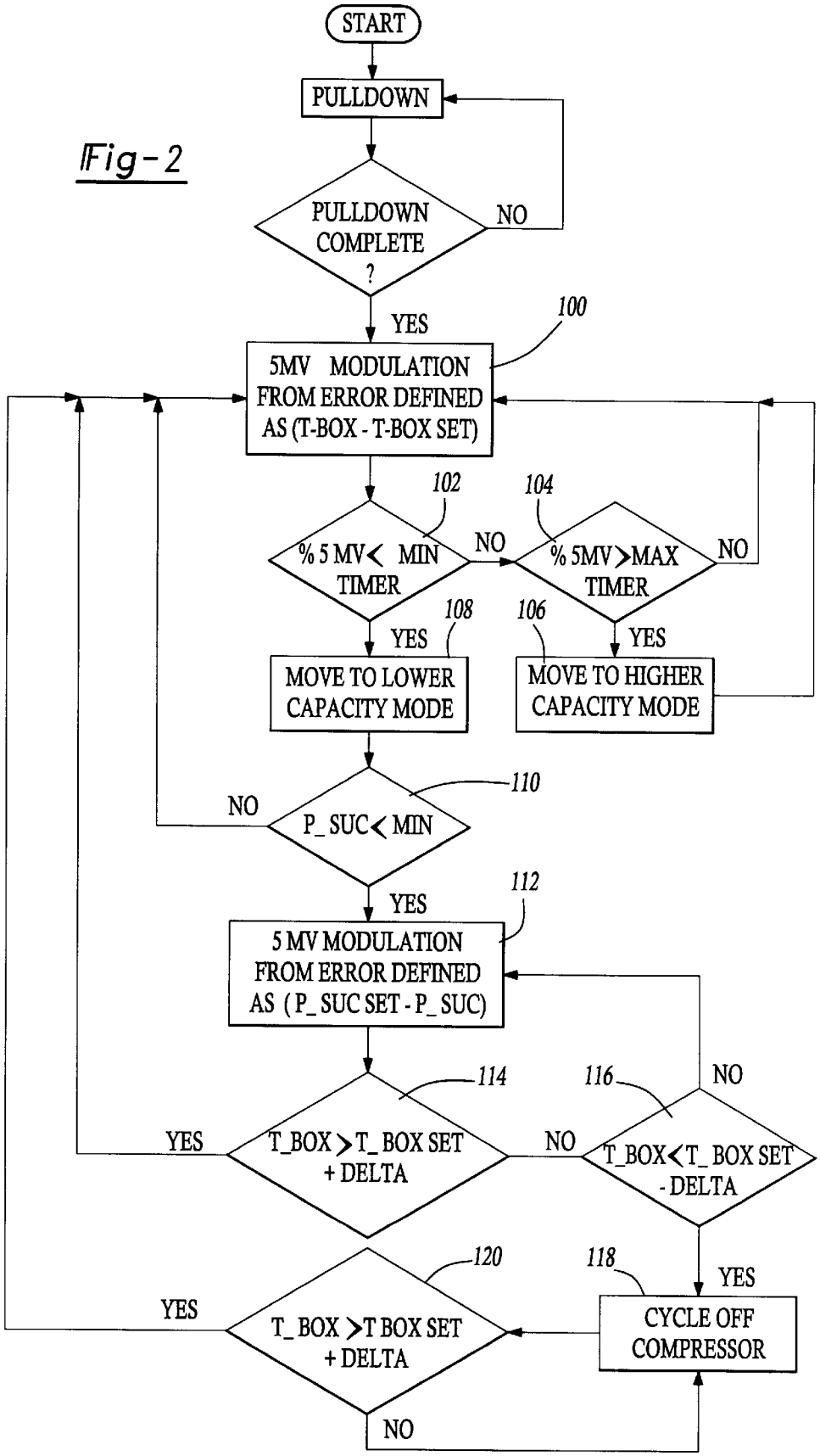
FIG. 2 is a flow chart of one method of steady state operation included in the present invention.

A method for steady state operation of the refrigeration system 20 is illustrated in the flow chart form in FIG. 2.

As shown, when the system is initially started, the container is typically at a temperature above a target temperature. Thus, a pull down method is initiated. The pull down method is best described in co-pending U.S. patentapplication Ser. No. 08/108,787, filed Jul. 2, 1998, and entitled "Method of Optimizing Cooling Capacity, Energy Efficiency and Reliability of a Refrigeration System During Temperature Pull Down."

As the pull down is ongoing, a control continues to compare the temperature in the refrigerated container, or the $box_T$ temperature to the $target_T$ temperature. If the two temperatures are not within a predetermined range of each other, then the pull down mode continues. However, at some point, the temperature difference between the temperature in the container $box_T$ is within a predetermined range of the $target_T$ temperature. At that point, the control enters steady state operation.

The flow chart shown in FIG. 2 is a simplified representation of one rather detailed control method. Selected portions of this method may be utilized rather than the entire method, and the basic concept of driving the refrigeration system to optimum capacity regime may also be utilized in a more simplified form. As shown in the FIG. 2 flow chart, once steady state operation is entered, the microprocessor checks if the refrigeration system is operating in its lowest capacity state.

For the refrigeration system shown in FIG. 2, there are several basic states which are available. Generally, the highest capacity state would include the economizer being operated, with the unloader valve closed and the suction throttling device 34 fully opened. By opening and closing the suction throttling device, various gradations between the broader modes of operation can be achieved.

Generally speaking, the next lowest capacity would include the economizer circuit being closed by the shutoff valve 28 and the by-pass line 46 being closed by unloader valve 36. This is known as standard operation.

The next lowest capacity operation would include the economizer circuit being closed, and the unloader valve 36 being opened.

As shown in the flowchart of FIG. 2, once pull down is complete, which is defined as the box temperature $T_{box}$ being within a particular range of the desired box temperature $T_{boxset}$, then steady state mode is entered. As shown in FIG. 2, steady state mode begins with a box 100 wherein a suction modulation valve is modulated to close or open depending on the difference between $T_{box}$ and $T_{boxset}$. Preferably, the suction modulation valve is closed in a series of steps. Controls for controlling and closing the suction modulation valve in a series of steps are known, however, they have not been utilized to perform the method such as in this application. If the $T_{box}$ is above the $T_{boxset}$, then the suction modulation valve opening is increased, whereas if the $T_{box}$ is below or equal to the $T_{boxset}$, the suction modulation valve opening is decreased. At box 102, if the suction modulation valve is closed below a predetermined minimum percentage, then a timer is initiated, and if predetermined time is exceeded, then the system moves to a lower capacity mode, as set forth at box 108. On the other hand, if the suction modulation valve is not closed below the predetermined minimum, then the system moves to box 104 which checks if the suction modulation valve is above a maximum number. Again, if the answer to box 104 is yes for a period of time which exceeds a timer, then the system moves to box 106, wherein the capacity of the compressor is increased. Box 106, and box 104, in response to a no, return to box 100.

After box 108, the control checks if the suction pressure is less than a minimum at box 110. If the answer is no, the system returns to box 100. If the answer is yes, then the system moves to pressure control mode, rather than temperature control mode. As shown in box 112, in pressure control mode the suction modulation valve modulation is based upon an error defined as the suction pressure set point $P_{sucset}$, minus the actual suction pressure $P_{suc}$. The suction modulation valve is modulated then to ensure that the suction pressure does not drop to an undesirably low value. From box 112, the control moves to box 114, which checks whether the temperature in the container $T_{box}$ is greater than $T_{boxset}$ plus a range for error. If the answer is yes, then the system moves out of pressure control and back to box 100. If the answer is no, then the control checks whether the $T_{box}$ number is less than $T_{boxset}$ minus a range. If the answer to box 116 is no then, the system returns to box 112. Essentially, the loop of boxes 112, 114, and 116 ensure that the suction pressure does not drop below acceptable value when the system is operating at very low capacity.

If the answer to box 116 is yes, then the system cycles the compressor off at box 118. The control continues to monitor $T_{box}$ and $T_{boxset}$, and as long as the $T_{box}$ does not exceed the $T_{boxset}$ plus a range, the compressor is maintained at cycled off at box 118. Once the $T_{box}$ exceeds the range at box 120, the system returns to box 100. The flowchart as shown in FIG. 2 will result in the refrigeration system being maintained at the lowest capacity mode, while allowing for proper operation of other system components.

In addition, the discharge temperature at the compressor outlet is monitored. If there is very low flow of refrigerant to the compressor, it may sometimes occur that the compressor temperature can increase to undesirable levels. If it is determined that the compressor is at an undesirably high temperature, then the suction modulation valve may be opened to increase refrigerant flow and to decrease the compressor temperature. Notably, this function is related to compressor temperature and not the temperature of the container, or $T_{box}$. Once the mass flow to the compressor is increased, at some time later it is likely that the container, $T_{box}$, will fall below the desired temperature $T_{boxset}$. The compressor then cycles off. The control would take this as the equivalent to box 118, and continue operation as shown in flowchart FIG. 2 under these conditions.

What is claimed is:

1. A method of operating a compressor in a cooling system in steady state operation comprising the steps of:

(1) monitoring the temperature within a container and comparing it to a target temperature, and entering steady state operation once the two temperatures are within a predetermined range of each other;

(2) monitoring operation of the cooling system once in steady state operation, and continuing to move to lower capacity operation while monitoring temperature, with a logic designed to have a plurality of modes and which moves the system to lower capacity mode operation if the system is still able to achieve acceptable temperatures, said movement to lower capacity operation includes throttling the suction for a predetermined period of time, and moving said system to a lower capacity state if the throttled suction does not cause the temperature to exceed said range after said predetermined period of time.

2. A method as set forth in claim 1, wherein the throttle is again opened if the temperature does begin to exceed the target temperature range within the predetermined period of time.

3. A method as recited in claim 1, wherein the compressor has an unloader valve, a suction throttling device, and an economizer circuit, and the control for the compressor attempts to move from economized operation to standard operation, and from standard operation to unloaded operation by performing the method steps of claim 2.

4. A method of operating a compressor in a cooling system in steady state operation comprising the steps of:

(1) monitoring the temperature within a container and comparing it to a target temperature, and entering steady state operation once the two temperatures are within a predetermined range of each other;

(2) monitoring operation of the cooling system once in steady state operation, and continuing to move to lower capacity operation while monitoring temperature, with a logic designed to have a plurality of modes and which moves the system to lower capacity mode operation if the system is still able to achieve acceptable temperatures, wherein the suction pressure is monitored, at least when the compressor is in a lowest capacity state, and switches to suction pressure control in the event that the suction pressure drops below a predetermined limit, and in suction pressure control, the system monitors the suction pressure, and modifies the operation of suction throttling device in view of the suction pressure, rather than the temperature.

5. A method as recited in claim 4, wherein the movement to the lower capacity operation includes throttling the suction for a predetermined period of time, and moving the system to a lower capacity state if the throttled suction does not cause the temperature to exceed said range after said predetermined period of time.

6. A method as set forth in claim 5, wherein said control moves back to modifying the operation of the suction throttling device based on the temperature, if the temperature within the container is greater than the target temperature plus a predetermined difference Δ.

7. A method as set forth in claim 5, wherein said control cycles the compressor off if the temperature within the container is less than the target temperature minus a predetermined difference Δ.

8. A method of operating a compressor in a cooling system in steady state operation comprising the steps of:

(1) monitoring the temperature within a container and comparing it to a target temperature, and entering steady state operation once the two temperatures are within a predetermined range of each other;

(2) monitoring operation of the cooling system once in steady state operation, and continuing to move to lower capacity operation while monitoring temperature, with a logic designed to have a plurality of modes and which moves the system to lower capacity mode operation if the system is still able to achieve acceptable temperatures, wherein discharge temperature is monitored, and the compressor switches to discharge temperature control if the monitored discharge temperature drops below a predetermined limit, and while in discharge temperature control, said control monitors discharge temperature and performs at least one of the steps of modifying the suction throttling device and switching between economized operation, standard operation and unloaded operation while said discharge temperature is below a specified discharge temperature limit.

9. A method of operating a compressor in a cooling system in steady state operation comprising the steps of:

(1) monitoring the temperature within a container and comparing it to a target temperature, and entering steady state operation once the two temperatures are within a predetermined range of each other;

(2) monitoring operation of the cooling system once in steady state operation, and continuing to move to lower capacity operation while monitoring temperature, with a logic designed to have a plurality of modes and which moves the system to lower capacity mode operation if the system is still able to achieve acceptable temperatures, wherein discharge pressure is monitored, and the compressor switches to discharge pressure control if the monitored discharge pressure drops below a predetermined limit, and while in discharge pressure control, said control monitors discharge pressure and performs at least one of the steps of modifying the suction throttling device and switching between economized operation, standard operation and unloaded operation while said discharge pressure is below a specified discharge pressure limit.

* * * * *